US010320136B2

(12) United States Patent
Michelmann et al.

(10) Patent No.: US 10,320,136 B2
(45) Date of Patent: Jun. 11, 2019

(54) ADAPTER WITH AT LEAST TWO ADAPTER PARTS WHICH ARE CONNECTABLE TO ONE ANOTHER

(71) Applicants: Folke Michelmann, Tittmoning (DE); Markus Schichl, Seekirchen (AT)

(72) Inventors: Folke Michelmann, Tittmoning (DE); Markus Schichl, Seekirchen (AT)

(73) Assignee: Rosenberger Hochfrequenztechnik GMBH & CO. KG, Fridolfing (DE)

( * ) Notice: Subject to any disclaimer, the term of this patent is extended or adjusted under 35 U.S.C. 154(b) by 0 days.

(21) Appl. No.: 15/445,017

(22) Filed: Feb. 28, 2017

(65) Prior Publication Data

US 2017/0229827 A1 Aug. 10, 2017

Related U.S. Application Data

(63) Continuation of application No. 14/440,682, filed on May 5, 2015, now abandoned.

(51) Int. Cl.
*H01R 13/60* (2006.01)
*H01R 13/62* (2006.01)
*H01R 31/06* (2006.01)

(52) U.S. Cl.
CPC ..... *H01R 31/06* (2013.01); *H01R 13/6205* (2013.01)

(58) Field of Classification Search
CPC ..... H01R 31/06; H01R 13/6205; H01R 13/6582; H01R 13/6275; H01R 23/27; H01R 24/84
USPC ..... 439/38–5, 607.24
See application file for complete search history.

(56) References Cited

U.S. PATENT DOCUMENTS 5,784,253 A * 7/1998 Ooka ..... G06F 1/1632 361/679.43
6,863,544 B2 3/2005 Ng
7,074,061 B1 7/2006 Roth et al.
7,513,038 B2 * 4/2009 Koh ..... H01R 13/6205 29/825
7,517,222 B2 * 4/2009 Rohrbach ..... H01R 13/6205 439/39
7,607,920 B1 10/2009 Chen
7,874,844 B1 1/2011 Fitts, Jr.
8,226,444 B2 * 7/2012 Chow ..... H01R 25/003 439/651
8,497,753 B2 * 7/2013 DiFonzo ..... H01R 13/641 335/205

(Continued)

FOREIGN PATENT DOCUMENTS

CN 101039004 A * 9/2007
WO WO2010011983 A1 1/2010

(Continued)

OTHER PUBLICATIONS

Translation. CN 101039004. Liao Shengxing. Composite Simple Plug. Mar. 17, 2006.*

*Primary Examiner* — Edwin A. Leon
*Assistant Examiner* — Milagros Jeancharles
(74) *Attorney, Agent, or Firm* — Randall Danskin P.S.

(57) ABSTRACT

An adapter having two adapter parts is disclosed, and wherein the respective adapter parts are arranged so as to permit the respective adapter parts to be releasably coupled in only one orientation and which facilitates the rapid coupling and decoupling of an electronic device to another device.

8 Claims, 3 Drawing Sheets

(56) References Cited

U.S. PATENT DOCUMENTS

| | | | | |
|---|---|---|---|---|
| 8,894,420 | B2 | 11/2014 | Schichl et al. | |
| 9,147,965 | B2 * | 9/2015 | Lee | H01R 13/6205 |
| 9,184,545 | B2 | 11/2015 | Chen et al. | |
| 9,312,651 | B2 | 4/2016 | Hsiang | |
| 9,362,664 | B2 | 6/2016 | Yen | |
| 9,367,790 | B2 * | 6/2016 | Avagliano | G07F 7/0833 |
| 2004/0224539 | A1 | 11/2004 | Boyd et al. | |
| 2010/0136801 | A1 * | 6/2010 | Limpkin | G02B 6/3817 439/39 |
| 2013/0094154 | A1 * | 4/2013 | Shen | H01R 13/502 361/731 |
| 2013/0223019 | A1 * | 8/2013 | Strisower | H05K 5/0286 361/747 |
| 2014/0273644 | A1 | 9/2014 | Mcsweyn et al. | |
| 2015/0093922 | A1 * | 4/2015 | Bosscher | H01R 13/665 439/39 |
| 2015/0094713 | A1 * | 4/2015 | Pham | H01R 13/6205 606/41 |

FOREIGN PATENT DOCUMENTS

| | | | |
|---|---|---|---|
| WO | WO2010099168 | A1 | 9/2010 |
| WO | WO2011141328 | A1 | 11/2011 |

* cited by examiner

ADAPTER WITH AT LEAST TWO ADAPTER PARTS WHICH ARE CONNECTABLE TO ONE ANOTHER

This Utility Patent Application is a Continuation Application of earlier filed and presently pending U.S. application Ser. No. 14/440,682 filed on May 5, 2015, and which claims priority from German Patent Application Serial No. 20 2012 010 703.8, and which was filed on Nov. 9, 2012; and PCT Application Serial No. PCT/EP2013/051204, and which was filed on Jan. 23, 2013. The above referenced applications are all for the same invention, and all by the same inventors.

The present invention relates to an adapter with at least two adapter parts which can be coupled to each other, and wherein a first adapter part has, at a first end, a plug for coupling to a USB socket.

Adapters for coupling to a USB socket or to a USB interface, which is generally also referred to as a USB port, are known from the general prior art. USB sockets are, for example, common in computers in order to connect external components or peripherals directly or via a connection cable. The external components can, for example, be USB memory sticks which can generally also be referred to as USB sticks. USB memory sticks are understood to be mass storage devices which can be connected via the USB socket. The external components can, for example, also be external hard drives, MP3 players, digital cameras and the like.

Because they can be accessed quickly and are easy to handle, USB memory sticks have in particular established themselves and so prevailed over other mass storage devices. The use of USB sockets has also established itself as the preferred means for joining two electronic components together.

So that they can be coupled directly to the USB socket, the external components can have a USB plug at one end. This is a standard plug. The USB plug can thus be designed as an integral part of, for example, a USB memory stick or another peripheral. It is also known that a cable, the end of which the external component or the peripheral is then connected or can be connected to, is then connected to the USB plug. This is, for example, the norm for connecting digital cameras, or for connecting larger external hard drives. When the coupling is effected via a connection cable that is plugged into the USB socket by means of a USB plug, the device to be connected via the USB socket can be coupled to the cable in any fashion, preferably also via a USB interface.

The disadvantage of a USB socket consists in the fact that it is inconvenient to plug in and unplug the USB plug, in particular when it is intended to connect multiple USB devices regularly to the USB socket.

Adapters are known from the prior art and which can be plugged into a USB socket, and to that end of which is averted or on the opposite end from the USB socket, a cable or a peripheral is then connected to same. In order to connect the cable or the peripheral, adapters of this type can also have a USB interface (USB plug or USB socket) or have any type of plug or another type of socket. However, handling is not made easier as a result, in particular when it is intended to couple multiple devices or cables regularly to the USB socket.

The object of the present invention is to provide an adapter by means of which it is possible to connect a cable or an external component or a peripheral simply, quickly and reliably to a USB socket.

This object is achieved according to the invention by an adapter with at least two adapter parts which can be coupled to each other, and wherein a first adapter part has, at a first end, a plug for coupling to a USB socket and, at a second end, at least one first electrical contact element, and a first part of a magnetic coupling device, and wherein a second adapter part has, at a first end which is provided for coupling to the second end of the first adapter part, at least one electrical counter-contact element, and a second part of the magnetic coupling device, and an interface at a second end, and wherein the first adapter part forms, at its second end, at least one contact face which is inclined relative to a cross-sectional surface which is oriented at right angles to a longitudinal axis of the adapter, and wherein the second adapter part has a complementary contact face at its first end and the contact faces adjoin each other in a plane-parallel fashion when the adapter parts are coupled magnetically to each other.

Because the adapter according to the present invention has at least two adapter parts which can be coupled to each other magnetically, a cable, but also any electronic device, can be connected particularly simply and comfortably to a USB socket. For this purpose, the first adapter part according to the present invention has, at a first end, a plug for coupling to a USB socket. It may hereby be a standard USB plug. Moreover, the first adapter part has, at a second end, at least one first electrical contact element, and preferably multiple contact elements, and further a first part of a magnetic coupling device.

According to the present invention, it is provided that a second adapter part has, at a first end which is provided for coupling to the second end of the first adapter part, at least one electrical counter-contact element, and preferably multiple counter-contact elements; and a second part of the magnetic coupling device. The second adapter part can have, at a second end, an interface, which is preferably a USB socket.

The first adapter part forms, at its second end, at least one contact face which is inclined relative to a cross-sectional surface and which is further oriented at right angles to the longitudinal axis of the adapter. The second adapter part has, at its first end, a complementary contact face. The respective contact faces adjoin each other in a plane-parallel fashion when the adapter parts are magnetically, and releasably coupled to each other by the force provided by the magnetic coupling device.

The advantage of the solution according to the teachings of the present invention first consists at least in part in the fact that the first adapter part can be introduced into a USB socket and remain there. In order to connect a cable or a device or any external component to the USB socket, the second adapter part is first coupled to the cable or the external component to be connected. In order then to effect a coupling between the cable or the external component and the USB socket, it is sufficient to couple the two adapter parts to each other, which is particularly simple because of the magnetic coupling device, and can even take place automatically by the two adapter parts being moved toward each other. A cable or an external component can thus be connected to a USB socket simply, quickly and reliably. It is advantageous if multiple cables or external components are provided with a second adapter part so that there is no need to remove the second adapter part from an external component or a cable and attach it to a different component.

It is in principle possible that the second adapter part is already part of the cable or the second adapter part is integrated into an external component.

It can be advantageous if the second adapter part and/or the first adapter part is connected directly to a cable or coupled firmly to a cable. The corresponding adapter part can be used with the attached cable as a lead.

If the second adapter part is part of a cable or a cable is connected directly to the second adapter part, within the sense of the claims as provided the cable can represent a part of the second adapter part. The interface provided according to the invention of the second adapter part is then preferably formed at the free end of the cable. The interface can have any design, for example a plug or socket, and in particular a USB plug or a USB socket.

Analogously, the first adapter part can likewise be part of a cable or be coupled directly to a firmly connected cable. In this case, the cable can preferably form, at the end averted, or opposite from the magnetic coupling device, a plug for coupling to a USB socket.

Another particular advantage of the present invention consists in the fact that, because the contact faces are spacially arranged or inclined relative to the cross-sectional area of the adapter, the magnetic coupling device can be integrated into the contact faces particularly advantageously. Moreover, the contact elements and the counter-contact elements can be integrated particularly advantageously, and wherein it is also possible for the contact elements and/or the counter-contact elements to take the form of flat contacts, contact strips, or contact springs. It is also possible to design or arrange the contact elements and/or the counter-contact elements in such a fashion that they are spring-loaded.

Still another advantage of the arrangement of the contact faces so that they are inclined relative to the cross-sectional area of the adapter consists in the fact that the magnetic coupling device is assisted or it is at least possible that the contact faces can at least absorb some of the load of the second adapter part or of the cable coupled thereto, or of the external component coupled thereto. In the case where the two adapter parts are coupled via contact faces which extend in plane-parallel fashion with the cross-sectional area, the contact face cannot absorb any forces so that in this case only the magnetic coupling device is decisive or effective for holding or securing the second adapter part against the first adapter part. In particular when a USB stick is, for example, connected directly to the second adapter part, loads and bending forces can occur which can result in undesired loosening of the magnetic coupling between the two adapter parts. This requires the magnets to have a particularly strong design. However, when the magnets are arranged in contact faces which extend in plane-parallel fashion with the cross-sectional area, since the magnets extend essentially in the same direction as the longitudinal axis of the adapter, this can result in space problems, especially when large magnets are intended to be used. This problem can be mitigated or prevented by the contact faces being inclined according to the teachings of the present invention relative to the cross-sectional area. It is here preferable if the contact faces of the adapter parts extend at least approximately in plane-parallel fashion with a base face of the adapter. The base face as described hereinafter corresponds essentially to a face which extends in plane-parallel fashion with the two largest outer faces (top and bottom) of the USB plug at the first end of the first adapter part. The base face thus extends at right angles to the cross-sectional area.

It is advantageous if the contact faces are each integrated into a shoulder and the two adapter parts have a corresponding complementary design so that the first adapter part is coupled to the second adapter part by being moved toward each other in a direction which extends at an angle, preferably at right angles, to the longitudinal axis of the adapter part or to the direction in which the first adapter part is plugged, with its USB plug formed at the first end, into the USB socket.

It is advantageous if the first adapter part has, at its second end, a recess which forms the contact face, and at least one further bearing face, and wherein the second adapter part has, at its first end, a complementary recess which forms the contact face and at least one bearing face, and wherein the bearing faces and the contact faces of the adapter parts are in each case situated opposite one another in plane-parallel fashion when the adapter parts are coupled magnetically to each other.

Because the recess is designed in such a way that a contact face, and at least one further bearing face are created, this results in a particularly good coupling between the two adapter parts. It is hereby provided that the contact face and the bearing face of an adapter part do not extend in plane-parallel fashion but at an angle to each other.

It is advantageous if the first adapter part has, by virtue of the recess, a contact face and two bearing faces at its second end, and wherein the second adapter part has, at its first end, a complementary contact face and two complementary bearing faces, and wherein the bearing faces and the contact faces of the adapter parts are in each case situated opposite one another and in a plane-parallel fashion when the adapter parts are coupled magnetically to each other.

It is furthermore advantageous if the recess at the second end of the first adapter part forms a step or a shoulder and the first end of the second adapter part has a complementary design.

Because of the aforementioned design as a step or a shoulder, a contact face can be particularly advantageously formed in the respective adapter part, and in particular in conjunction with at least two further bearing faces. The bearing faces can here preferably extend in a plane-parallel fashion with each other. The bearing faces and the contact face preferably do not extend in a plane-parallel fashion.

It is advantageous if the contact faces of the adapter parts extend at least approximately in a plane-parallel fashion with the base face of the adapter. It is moreover advantageous if the bearing faces extend at least approximately in a plane-parallel fashion with the cross-sectional area of the adapter.

Because the contact faces extend in a plane-parallel fashion with a base face of the adapter, there is particularly good bearing contact in order to couple the first adapter part to the second adapter part.

It is advantageous if the contact face is arranged in the first adapter part in such a way that, when the first adapter part is plugged with its USB plug into a USB socket, the contact face at the second end of the first adapter part points upwardly and thus preferably extends or is oriented in a horizontal plane.

It is advantageous if the contact face is arranged in the first adapter part in such a way that the contact face points upwardly and extends in a horizontal plane when the first adapter part is oriented with its USB plug in such a way that the base face of the adapter is oriented in a plane-parallel fashion with a horizontal plane, and a space in the USB plug exists in the upper part of the USB plug, and which serves to receive a tongue of the USB socket.

The terms “upper”, “oriented upwardly”, “top”, “lower”, “oriented downwardly” and “underside” generally refer to a positioning of the adapter part in which the base face of the adapter is oriented in a plane-parallel fashion with a horizontal plane, and the space in the USB plug of the first adapter part, which is provided to receive a tongue of a USB socket, is situated in the upper part of the USB plug.

The steps in the two adapter parts are preferably designed in such a way that the steps each have a height which corresponds at least approximately to half the height of the adapter in the coupling region of the two adapter parts. It can here be advantageous if the length of the step, extending in the longitudinal direction of the adapter, corresponds to 1 to 4 times, and preferably to 1.5 to 2.5 times, the height of the step.

The step in the first adapter part is preferably designed in such a way that its underside forms part of the underside of the adapter. The top of the step preferably extends in a plane-parallel fashion with the base face in a plane which divides the adapter preferably approximately centrally with respect to its height, and wherein the contact face being formed by the top of the step and the contact face is oriented upwardly.

For this purpose, the step in the second adapter part preferably has a complementary design.

It is advantageous if, in the first adapter part, the step adjoins as closely as possible the USB plug which is provided for insertion into a USB socket.

It is advantageous if the magnetic coupling device is formed in the contact faces.

The magnetic coupling device can have at least one magnet which is arranged in the first part or in the second part of the magnetic coupling device. The magnet can here interact with a soft iron or a soft magnetic material as a counter-element in the respective other part or with a magnet.

According to the teachings of the present invention, the first part and/or the second part of the magnetic coupling device has at least one magnet. In the case of a design where multiple magnets are arranged in a part of the magnetic coupling device, a corresponding number of magnets or a corresponding number of counter-elements made from a soft magnetic material can be provided in the respective other part of the magnetic coupling device. Compounds or other variations are also possible. In each case, a magnet and a counter-element can be provided in each part. Multiple magnets or soft magnetic counter-elements are also possible.

It is advantageous if one part of the magnetic coupling device has at least one magnet, and preferably two magnets, and the other part of the magnetic coupling device has at least one soft magnetic material as a counter-element, and preferably two counter-elements.

It can furthermore be advantageous if the first part of the magnetic coupling device has at least two magnets and the second part of the magnetic coupling device has at least two magnets. In this arrangement, the magnets are oriented in such a way that individual magnets oriented with opposing poles are situated opposite each other when the first adapter part is coupled to the second adapter part.

The inventors believe that a product which includes two or at least two magnets is particularly advantageous in order to couple the two adapter parts to each other reliably. It can be provided that each adapter part has two magnets oriented with opposing poles so that the two adapter parts can particularly and advantageously be joined together, automatically.

It is advantageous if the at least one electrical contact element and the at least one electrical counter-contact element are in each case arranged in the respective contact faces.

It can be advantageous if the magnets are arranged in the contact faces in such a way that the contact elements and the counter-contact elements are situated between the magnets of a contact face.

It is furthermore advantageous if the at least one electrical contact element and the at least one electrical counter-contact element are designed as a flat contact or a contact strip, and wherein the at least one contact element and/or the at least one counter-contact element is designed or arranged so that they are spring-loaded.

It is advantageous if four contact elements and four counter-contact elements are provided in order to transmit data and/or electricity.

It is also advantageous if the two outer of the contact elements arranged preferably parallel next to each other are longer and/or are more spring-loaded than the two other contact elements, and wherein the two outer contact elements are preferably provided in order to transmit electricity and it is thereby intended to ensure that, when the two adapter parts are separated from each other, the electricity contacts remain in contact for a longer period of time than the data contacts.

It can furthermore be advantageous if the first adapter part has at least one shielding contact at its second end, and the second adapter part has at least one shielding contact at its first end in each case, and wherein the at least one shielding contact in the first adapter part contacts the at least one shielding contact of the second adapter part, when the adapter parts are magnetically coupled to each other.

It is advantageous if each adapter part has two shielding contacts, and wherein in each case a shielding contact of an adapter part is associated with a shielding contact of the other adapter part, and forms a shielding contact pair. It can here be advantageous if each shielding contact pair has a shielding contact which is designed or arranged so that it is spring-loaded. It is advantageous if the shielding contacts are designed as flat contacts, contact strips, or contact springs. The shielding contacts are preferably coupled to the housing of the respective adapter part in order to produce an advantageous shielding effect.

It is advantageous if an electrical contact element and an electrical counter-contact element form a contact pair. It is here advantageous if either the contact element or the counter-contact element is designed or arranged so that it is spring-loaded. This is preferable because it takes the form of a contact spring, and wherein the respective other element is designed as a flat contact or contact strip, that is, it is not spring-loaded. It is advantageous if either all the contact elements or all the counter-contact elements are designed so that they are spring-loaded, and preferably are provided as contact springs.

The second adapter part can have any interface at its second end. The interface may optionally also be replaced by an integrated mass storage device or a transmitter and/or receiver unit. The interface can preferably be designed as a USB socket. The interface can, however, also be designed as a USB plug or as any type of socket or any type of plug.

It is possible for the plug of the first adapter part to have any type of design. Although it is advisable that the plug is designed for coupling to a USB socket. However, the fundamental idea of the invention is not, necessarily limited to the use of the solution according to the invention for coupling to a USB socket. This is only a particularly suitable and practical design. If in particular the USB socket is in the future to be replaced by a different socket, the adapter according to the invention can be adapted thereto by redesigning the plug of the first adapter part.

A solution which is independent from the adapter with at least two adapter parts which can be coupled to each other is also provided. In this regard, an adapter part with a firmly coupled cable is claimed. In this arrangement, a cable coupled to one end of an adapter part, and preferably designed according to the second adapter part, is described. Alternatively, the adapter part can also have a design which corresponds to that of the first adapter part.

An independent inventive solution which is disclosed provides an adapter part with a first end which is provided for coupling to an end of a further adapter part. Electrical counter-contact elements and a part of a magnetic coupling device are formed at the first end of the adapter part. Moreover, a contact face which is inclined with respect to a cross-sectional area oriented at right angles to the longitudinal axis of the adapter is formed at the first end. The adapter part has, at its second end, a firmly coupled cable which has an interface at its end averted from the adapter part.

The further adapter part is preferably designed in the way described in the case of the adapter part already described, above.

The adapter part as claimed in the present application can preferably have individual or multiple features which are disclosed with respect to the second adapter part.

An exemplary embodiment of the invention is explained in principle, below, with reference to the drawings, in which.

Figure 1:
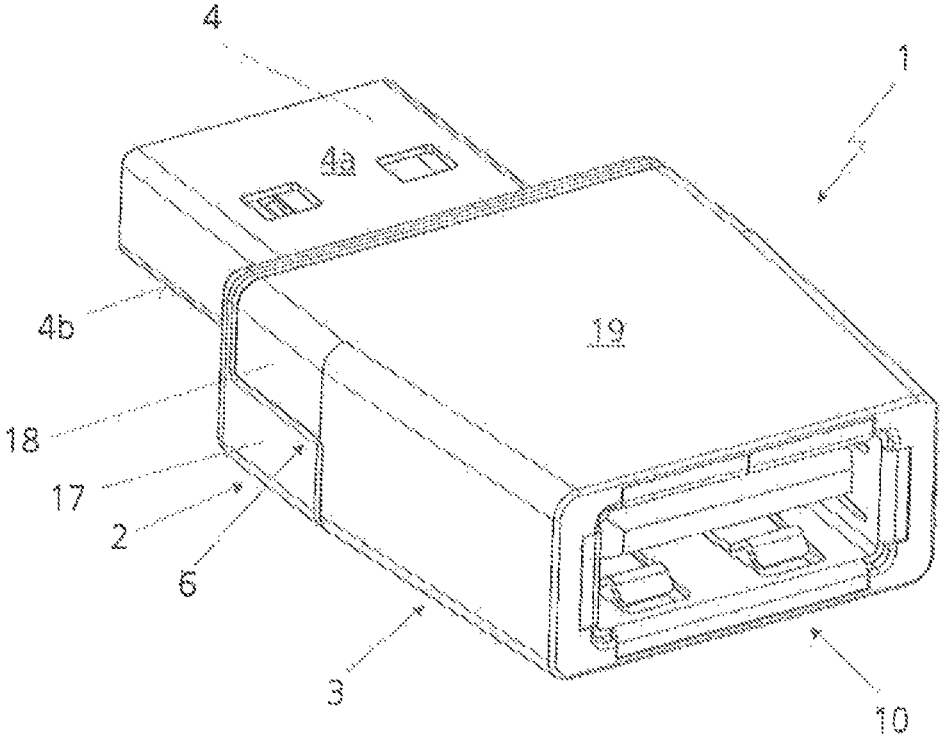
FIG. 1 shows a perspective view of the adapter according to the invention with two adapter parts coupled magnetically to each other.

FIG. 1 shows an adapter 1 with two adapter parts 2, and 3 and which can be magnetically coupled to each other. The first adapter part 2, which is also shown individually in FIG. 3, has at a first end a plug 4 for coupling to a USB socket (not shown in more detail). The plug 4 takes the form of a USB plug. At a second end, the adapter part 2 has multiple electrical contact elements 5 and a first part 6*a* of a magnetic coupling device 6. In the exemplary embodiment, the first adapter part 2 has four contact elements 5, the two contact elements 5 situated on the outside being provided in order to transmit electricity and the two contact elements 5 situated on the inside being provided in order to transmit data, although the design and the specific number of the contact elements 5 do not fall within the scope of the invention.

The first part 6*a* of the magnetic coupling device 6 has two magnets 7. A greater or lesser number of magnets 7 can, however, also be used here, as can a soft magnetic material instead of the magnets as described, above. The magnets 7 are preferably arranged in such a way that the contact elements 5 are situated between them.

Figure 2:
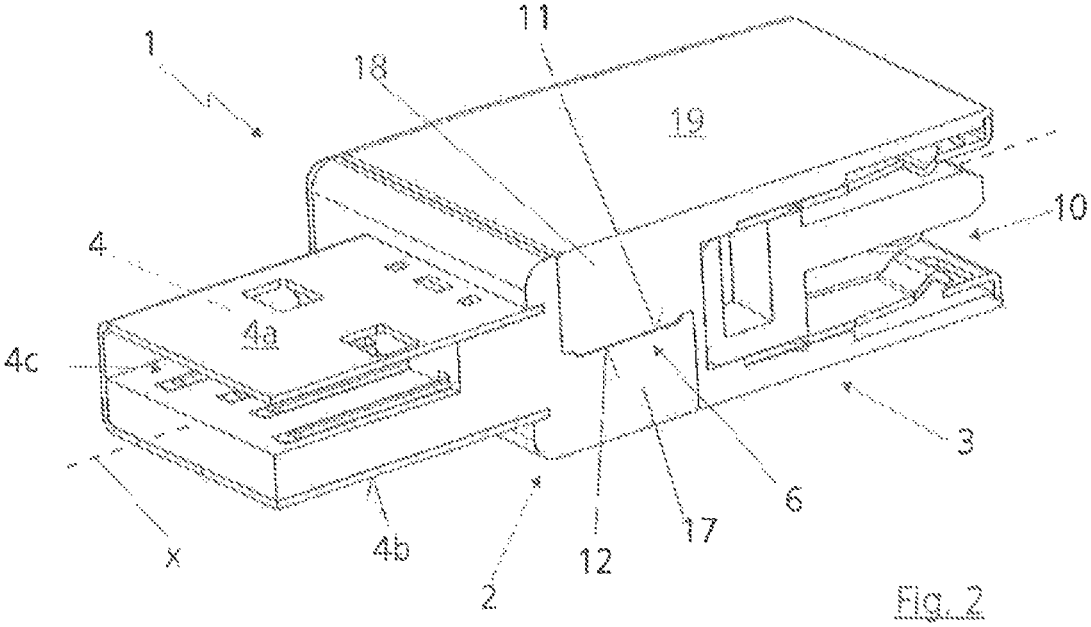
FIG. 2 shows a view in section of the adapter according to the invention from FIG. 1.

The second adapter part 3 has, at a first end, which is provided for coupling to the second end of the first adapter part 2, multiple electrical counter-contact elements, the number of which corresponds to the number of the contact elements 5. Furthermore, the first end of the second adapter part 3 has a second part 6*b* of the magnetic coupling device 6. The second part 6*b* of the magnetic coupling device 6 has two magnets 9 (or a soft magnetic material instead of the magnets) which are situated in corresponding fashion opposite the two magnets 7 when the first adapter part 2 is coupled to the second adapter part 3, as shown in FIGS. 1 and 2.

A magnet 7, and a magnet 9 form a magnetic contact pair, and wherein the magnets 7, and 9 are in each case arranged in such a way that the magnets 7, and 9 of a magnetic contact pair are situated with their poles arranged opposite to each other when the adapter parts 2, and 3 are coupled to each other, magnetically. It is in principle possible for one of the magnets of a magnetic contact pair to be replaced by a soft magnetic material.

In the exemplary embodiment, it can be provided that both the magnets 7, of the first adapter part 2, are oriented with opposing poles. Similarly, the magnets 9 in the second adapter part 3 can likewise be designed with opposing poles which are oriented so that the two adapter parts 2, and 3 can be coupled to each other only in a specific orientation. In the present case the adapter parts 2, and 3 can, because of their structural design, be coupled to each other only in one orientation. A corresponding magnetic orientation of the magnets 7, and 9 can, however, assist this or assist self-closing of the adapter parts 2, and 3.

The second adapter part 3 has an interface 10 at its second end, this being a USB socket in the exemplary embodiment. Alternatively, however, it can also be any type of socket. Moreover, it is possible for the interface 10 to take the form of a USB plug or any other type of plug.

The first adapter part 2 (see FIGS. 1 and 2) forms, at its second end, a contact face 11 which is inclined with respect to a cross-sectional area of the adapter 1, and which is further oriented at right angles to a longitudinal axis X of the adapter. The second adapter part 3 has a complementary contact face 12 at its first end. The contact faces 11, and 12 adjoin each other in a plane-parallel fashion when the adapter parts 2, and 3 are coupled to each other, magnetically, by the force of the magnetic coupling device 6, and which is shown in FIGS. 1 and 2, respectively.

Figure 3:
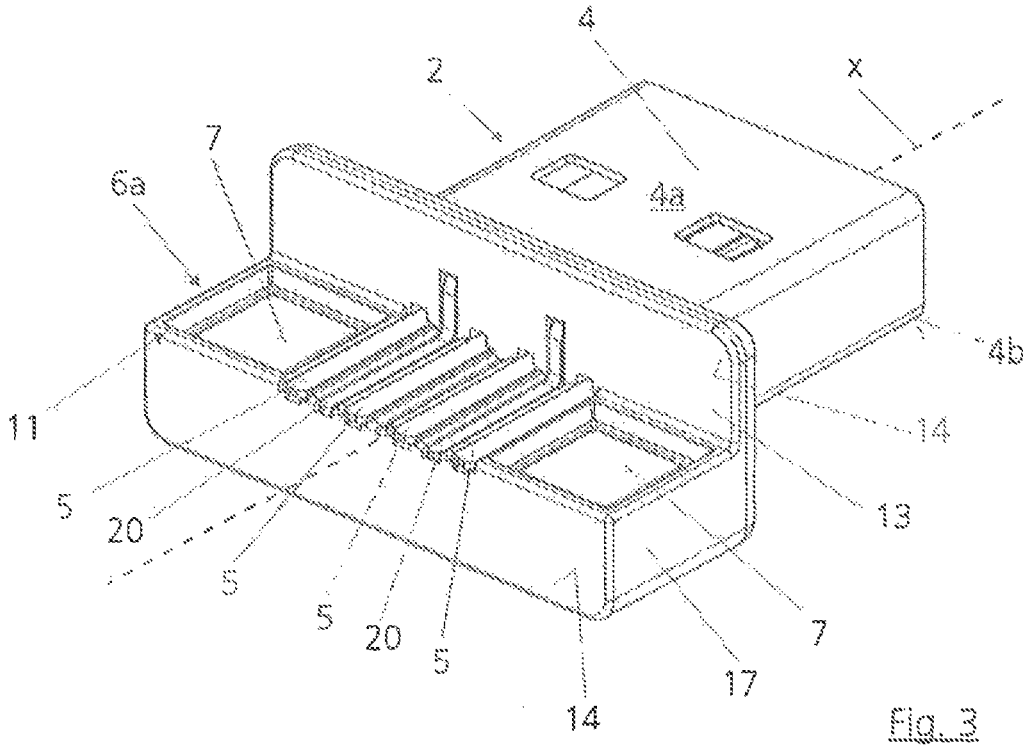
FIG. 3 shows a perspective view of the first adapter part.

The first adapter part 2 has, as is clear from a study of FIGS. 1 to 3, at its second end, a recess 13 and by which the contact face 11, and two bearing faces 14 are formed. The second adapter part 3 has a complementary design and has a recess 15 which forms a contact face 12 which complements the contact face 11, and two bearing faces 16 complementing the bearing faces 14. The bearing faces 14, and 16 and the contact faces 11, and 12 are in each case situated opposite to each other and are disposed in a plane-parallel orientation when the adapter parts 2, and 3 are coupled to each other magnetically, as shown in FIG. 1 and FIG. 2, respectively.

As should be clear from a study of FIGS. 1 to 3, the first adapter part 2 forms a step 17 because of the presence of the recess 13. The second adapter part 3 forms a corresponding complementary step 18. When situated one on top of the other, as is provided in order to couple the adapter parts 2, and 3, the respective steps 17, and 18 have a height dimension which essentially corresponds to the height of the adapter 1 in the adjoining regions.

The contact faces 11, and 12 of the adapter parts 2, and 3 extend in an at least approximately plane-parallel fashion with respect to a base face of the adapter 1. In the exemplary embodiment, the base face of the adapter 1 extends in an essentially plane-parallel fashion with respect to the top 19 of the housing (or, analogously, with respect to the bottom of the housing which is not shown in detail) of the adapter 1, as shown by way of example in FIG. 1. In the exemplary embodiment, the base face is also defined by the plug 4 of the first adapter part 2. The base face extends in a plane-parallel fashion with respect to the two largest outer faces 4*a*, and 4*b* of the plug 4, these being the top 4*a*, and the bottom 4*b*, of the plug 4.

The contact face 11 of the first adapter part 2 points upwardly and the contact face 12 of the second adapter part 3 points downwardly when the first adapter part is oriented with its USB plug 4 in such a way that the base face of the adapter is oriented in a plane-parallel fashion with respect to a horizontal plane, and a space 4*c* in the USB plug 4, serves to receive a tongue of the USB socket, is situated at the top in the USB plug 4.

The bearing faces 14, and 16 extend in an at least approximately plane-parallel fashion with respect to the cross-sectional area of the adapter 1.

Figure 4:
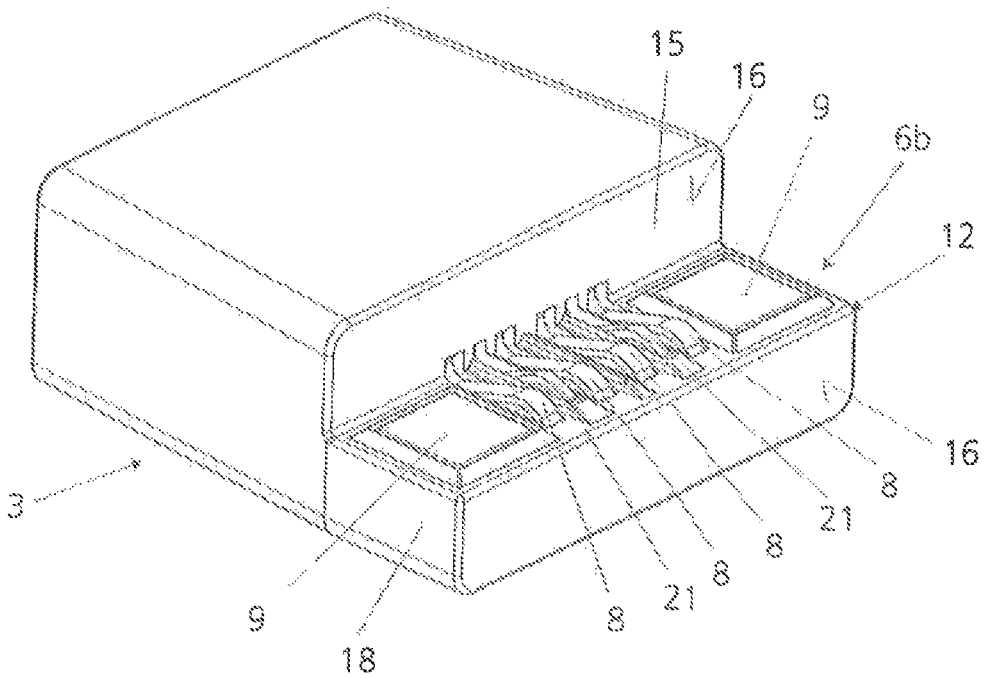
FIG. 4 shows a perspective view of the second adapter part.
Figure 5:
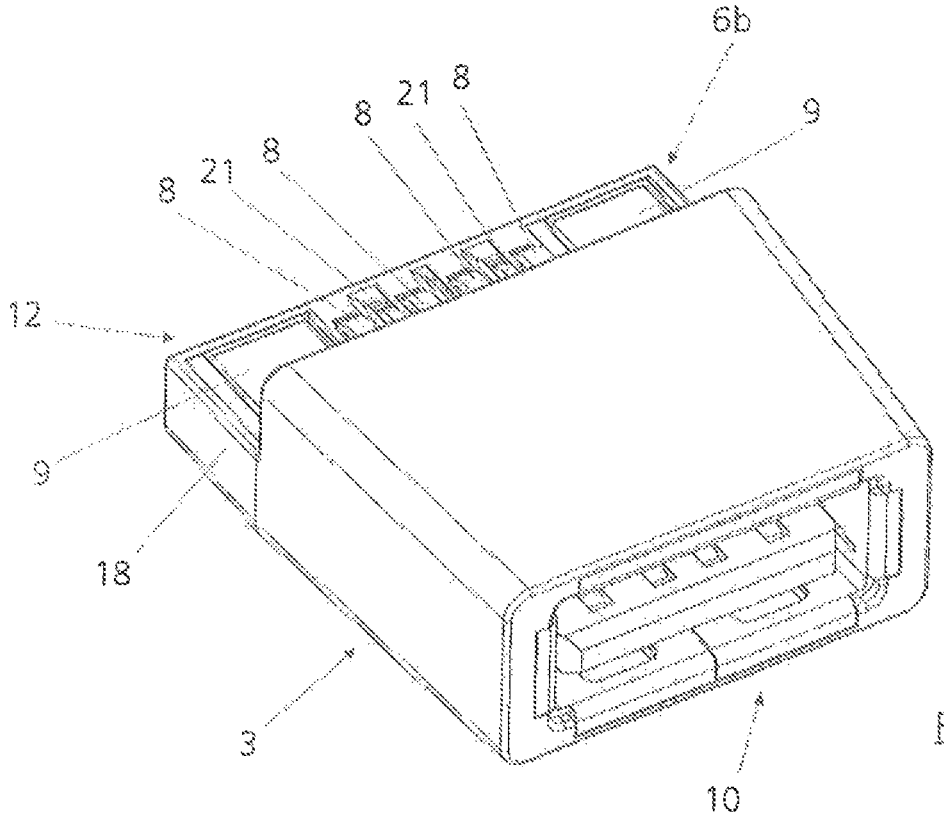
FIG. 5 shows a view of the second end of the second adapter part in a perspective view.

The magnetic coupling device 6 is, as is clear from FIGS. 3 to 5, and which is formed in the contact faces 11, and 12 has the already described magnets 7, and 9 or optionally counter-elements made from a soft magnetic material.

As is clear from a study of FIGS. 3 to 5, the contact elements 5, and the counter-contact elements 8, are also in each case arranged in the corresponding contact faces 11, and 12 or formed therein. In the exemplary embodiment, the contact elements 5 of the first adapter part 2 are designed as flat contacts or contact strips and preferably are not spring-loaded. In the exemplary embodiment, the counter-contact elements 8 are designed as contact springs or are spring-loaded, and/or are arranged in a spring-loaded fashion. As a result, reliable contacting of the contact elements 5 with the counter-contact elements 8 and a structurally simple product is ensured.

The first adapter part 2, and the second adapter part 3 each have at least one shielding contact 20, and 21 which are arranged in the contact faces 11, and 12 or are formed therein. The shielding contacts 20, and 21 contact each other when the first adapter part 2 is coupled magnetically to the second adapter part 3. The shielding contacts 20, and 21 are coupled, in a manner which is not shown in detail, to the respective housing of the associated adapter part 2, and 3 in order to produce a shielding effect. In the exemplary embodiment it is provided that the shielding contacts 21 are designed so that they are spring-loaded in the second adapter part 3, or as shielding contact springs. The shielding contacts 20 in the first adapter part 2 are preferably designed as flat contacts or strip contacts. This arrangement can, however, also be reversed. It is advantageous if all the contacts (contact elements 5, counter-contact elements 8, and shielding contacts 20, and 21) are formed in the contact faces 11, and 12 as flat contacts, or have a strip form, and which is designed or arranged in a partially spring-loaded fashion, in contrast to a design as contact pins.

In the exemplary embodiment, as illustrated, it is provided that the contact elements 5, the counter-contact elements 8, the shielding contacts 20, and 21 and the magnets 7, and 9 are, in each case, arranged symmetrically about a center axis or the longitudinal axis of the adapter.

Figure 6:
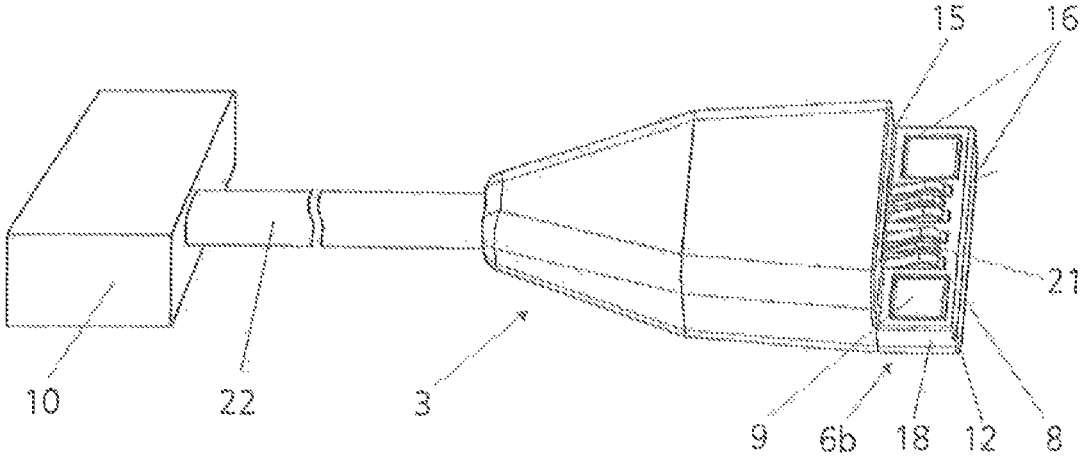
FIG. 6 shows an alternative design of the second adapter part with a firmly coupled cable.

FIG. 6 shows an alternative design of an adapter part. In the exemplary embodiment, this is shown by way of example with the aid of the second adapter part 3. The adapter part shown in FIG. 6 can, however, also have individual or multiple features of the first adapter part 2.

The second adapter part 3 shown in FIG. 6 has a cable 22, which is firmly coupled to its second end, and which forms the interface 10. The second adapter part 3 can be part of a cable 22.

The interface 10 which forms the cable 22 can, for example, take the form of a plug or a socket, and in particular a USB plug or a USB socket. However, any other type of design of the interface is also possible. For example, an electrical or electronic appliance, for example an audio or video unit or a camera, can also be connected directly to the interface 10.

The interface 10 preferably takes the form of a USB plug.

The interface 10 is preferably formed at that end of the cable 22 which is averted from the magnetic coupling device 6.

The cable 22 can be firmly coupled to the second adapter part 3, for example, by the cable 22 being connected directly, or the cable 22 being formed integrally with the second adapter part 3, or the cable 22 being coupled to the second adapter part 3 by means of a clamping, adhesive, or screw connection, or being connected firmly to the second adapter part 3.

The second adapter part 3 can, as long as it is not explicitly excluded by the connected cable 22, have the features which have already been described with respect to FIGS. 1 to 5.

The specific design of the second adapter part 3 shown in FIG. 6 is optional. The essential thing with respect to the alternative embodiment shown in FIG. 6 is that the second adapter part 3 has a cable 22 coupled firmly to its second end. This design can also be transferred to the other exemplary embodiments shown in FIGS. 1 to 5.

The second adapter part 3, and which is shown in FIG. 6 with the firmly coupled cable 22 illustrates an independent and advantageous inventive solution for a cable 22.

We claim:

1. An adapter having two complimentary adapter parts which can be magnetically coupled to each other, the adapter comprising:

a first adapter part having a first end and an opposing second end, with a longitudinal axis extending medially through the first adapter part from the first end to the second end, the first end of the first adapter part having a plug configured for releasable communicative engagement with a USB port of a first electronic device, and the second end of the first adapter part defining a recess step having two generally vertically oriented spaced apart bearing faces that limit movement along the longitudinal axis, and which are oriented transverse to the longitudinal axis and horizontally offset from one another with the recess step therebetween, and further having an angulated contact face that extends generally along the longitudinal axis between the two bearing faces, the angulated contact face carrying at least one strip type electrical contact and at least one shielding contact, and further wherein the angulated contact face of the first adapter part carries a magnet;

a second adapter part having a first end and an opposing second end, with a longitudinal axis extending medially through the second adapter part from the first end to the second end, the second end of the second adapter part having an interface for releasable communicative engagement with a second electronic device, and the first end of the second adapter part defining a recess step that is complementary to the recess step defined by the first adapter part, the recess step defined by the second adapter part having two generally vertically oriented spaced apart bearing faces that limit movement along the longitudinal axis, and which are oriented transverse to the longitudinal axis and horizontally offset from one another with the complementary recess step therebetween, and further having an angulated contact face that extends generally along the longitudinal axis and is positioned between the two spaced apart bearing faces, the angulated contact face carrying at least one spring loaded electrical counter contact and at least one shielding contact, and further wherein the angulated contact face of the second adapter part carries a magnet; and the magnet carried by the contact face of the first adapter part and the magnet carried by the contact face of the second adapter part are oriented such that the magnets are magnetically attracted to one another to cause the first adapter part contact face and the second adapter part contact face to magnetically connect vertically so that the spaced apart generally vertically oriented bearing faces of the first and second adapter parts are immediately adjacent one another so that the plural spring loaded electrical counter contacts of the second adapter part contact face are in direct physical contact the plural strip type electrical contacts of the first adapter part contact face to provide electrical communication between and through the first adapter part and the second apart between the USB plug and the interface.

2. The adapter of claim 1 and wherein the magnet of the first adapter part is positioned within the contact face of the first adapter part and laterally outward of the at least one electrical contact;

the magnet of the second adapter part is positioned within the contact face of the second adapter part and laterally outward of the at least one electrical counter contact; and the magnet in the first adapter part and the magnet in the second adapter part are aligned within the contact faces so as to be magnetically attracted to one another.

3. The adapter of claim 1 further comprising:

two magnets within the contact face of the first adapter part, each magnet laterally outward of the at least one strip type electrical contact and laterally outward of the at least one shielding contact;

two magnets within the contact face of the second adapter part, each magnet laterally outward of the at least one spring loaded electrical counter contact and laterally outward of the at least one shielding contact; and the magnets within the contact face of the first adapter part and the magnets within the contact face of the second adapter part are oriented to be magnetically attracted to the proximate magnet in the complimentary adapter part when the two adapter parts are magnetically interconnected.

4. The connector of claim 1 further comprising:

plural spacedly arrayed electrical contacts carried by the contact face of the first adapter part; and plural spacedly arrayed spring loaded electrical counter contacts carried by the contact face of the second adapter part.

5. The connector of claim 1 further comprising:

plural spacedly arrayed shielding contacts carried by the contact face of the first adapter part and the plural spacedly arrayed shielding contacts are spacedly adjacent to and parallel to the at least one electrical contact; and plural spacedly arrayed shielding contacts carried by the contact face of the second adapter part and the plural spacedly arrayed shielding contacts are spacedly adjacent to and parallel to the at least one electrical counter contact.

6. The connector of claim 1 and wherein the first adapter part is magnetically interconnected with and magnetically disconnected from the second adapter part with motion that is transverse to the longitudinal axis and is not axial along the longitudinal axis.

7. The connector of claim 1 and wherein the angulated contact face of the first adapter part is parallel to the longitudinal axis and perpendicular to the two offset bearing faces; and the angulated contact face of the second adapter part is parallel to the longitudinal axis and transverse to the two spaced apart and offset bearing faces.

8. An adapter having two complimentary adapter parts which can be magnetically coupled to each other, the adapter comprising:

a first adapter part having a first end and an opposing second end, with a longitudinal axis extending medially through the first adapter part from the first end to the second end, the first end of the first adapter part having a plug configured for releasable communicative engagement with a USB port of a first electronic device, and the second end of the first adapter part defining a recess step having two generally vertically oriented spaced apart bearing faces that are oriented transverse to the longitudinal axis and further having a generally horizontally oriented contact face that extends generally along the longitudinal axis and is positioned between the two generally vertically oriented spaced apart bearing faces, the generally horizontally oriented contact face carrying plural spacedly arrayed strip type electrical contacts and plural shielding contacts positioned parallel to and spacedly adjacent the plural strip type electrical contacts, and further wherein the generally horizontally oriented contact face of the first adapter part carries magnets laterally outward of the plural strip type electrical contacts;

a second adapter part having a first end and an opposing second end, with a longitudinal axis extending medially through the second adapter part from the first end to the second end, the second end of the second adapter part having an interface for releasable communicative engagement with a second electronic device, and the first end of the second adapter part defining a recess step that is complementary to the recess step defined by the first adapter part, the recess step defined by the second adapter part having two generally vertically oriented spaced apart bearing faces that are oriented transverse to the longitudinal axis and further having a generally horizontally oriented contact face that extends generally along the longitudinal axis and is positioned between the two generally vertically oriented spaced apart bearing faces, the generally horizontally oriented contact face carrying plural spacedly arrayed spring loaded electrical counter contacts and plural shielding contacts positioned parallel to and spacedly adjacent the plural spring loaded electrical counter contacts, and further wherein the generally horizontally oriented contact face of the second adapter part carries magnets laterally outward of the plural spring loaded electrical counter contacts; and the magnets carried within the generally horizontally oriented contact face of the first adapter part and the magnets carried within the generally horizontally oriented contact face of the second adapter part are oriented such that the magnets are magnetically attracted to one another to cause the first adapter part contact face and the second adapter part contact face to magnetically connect vertically so that the spaced apart generally vertically oriented bearing faces of the first and second adapter parts are immediately adjacent one another so that the plural spring loaded electrical counter contacts of the second adapter part contact face are in direct physically contact the plural strip type electrical contacts of the first adapter part contact face to provide electrical communication between and through the first adapter part and the second apart between the USB plug and the interface.

* * * * *